US011529537B1

(12) United States Patent
Bravo et al.

(10) Patent No.: US 11,529,537 B1
(45) Date of Patent: Dec. 20, 2022

(54) COLLAPSIBLE EXERCISE APPARATUS

(71) Applicants: John Bravo, Tucson, AZ (US); Therese Cleary, Tucson, AZ (US)

(72) Inventors: John Bravo, Tucson, AZ (US); Therese Cleary, Tucson, AZ (US)

( * ) Notice: Subject to any disclaimer, the term of this patent is extended or adjusted under 35 U.S.C. 154(b) by 54 days.

(21) Appl. No.: 17/193,118

(22) Filed: Mar. 5, 2021

(51) Int. Cl.

| | |
|---|---|
| ***A63B 17/04*** | (2006.01) |
| ***A63B 21/055*** | (2006.01) |
| ***A63B 21/04*** | (2006.01) |
| ***A63B 21/16*** | (2006.01) |
| ***A63B 21/00*** | (2006.01) |
| ***A63B 69/20*** | (2006.01) |

(52) U.S. Cl.
CPC ..... *A63B 17/04* (2013.01); *A63B 21/0442* (2013.01); *A63B 21/0552* (2013.01); *A63B 21/154* (2013.01); *A63B 21/16* (2013.01); *A63B 21/4035* (2015.10); *A63B 69/20* (2013.01); *A63B 2210/50* (2013.01); *A63B 2225/093* (2013.01); *A63B 2225/105* (2013.01)

(58) Field of Classification Search
CPC . A63B 17/04; A63B 21/0442; A63B 21/0552; A63B 21/4035; A63B 2210/50; A63B 2225/093; A63B 2225/105; A63B 21/02–0442; A63B 21/055–0557; A63B 21/154–156; A63B 21/16–1681; A63B 69/20–208; A63B 69/34; A63B 21/078; A63B 21/156; A63B 23/03558
See application file for complete search history.

(56) References Cited

U.S. PATENT DOCUMENTS

| | | | | |
|---|---|---|---|---|
| 4,705,267 | A * | 11/1987 | Jackson | A63B 21/4029 482/106 |
| 5,536,229 | A | 7/1996 | Albergo | |
| 5,997,448 | A * | 12/1999 | Duba | A63B 21/1681 482/121 |
| 9,320,934 | B1 * | 4/2016 | Pringle | A63B 21/068 |
| 10,512,813 | B1 | 12/2019 | Hayward | |
| 10,646,738 | B2 * | 5/2020 | Arturo | A63B 21/156 |
| 2007/0099780 | A1 * | 5/2007 | Bowser | A63B 21/00043 482/148 |
| 2009/0069161 | A1 * | 3/2009 | Caldwell | A63B 21/4035 482/142 |
| 2013/0225372 | A1 * | 8/2013 | Rochford | A63B 21/0442 482/129 |
| 2014/0018215 | A1 * | 1/2014 | Donofrio | A63B 21/169 482/129 |

(Continued)

*Primary Examiner* — Joshua Lee
*Assistant Examiner* — Catrina A Letterman
(74) *Attorney, Agent, or Firm* — Sanchelima & Associates, P.A.; Christian Sanchelima; Jesus Sanchelima

(57) ABSTRACT

An exercise apparatus including an exercise bar assembly, a pulley assembly and an exercise band assembly. The exercise bar assembly includes an exercise bar that has attachment point rods secured along a height thereof. Exercise bands from the exercise band assembly are secured to the desired of the attachment point rods. Attached along the height of the exercise bar are also pads used to practice kicking and punching. The exercise bands include handle straps allowing the user to grasp the exercise bands to work out the desired muscle group. Additional exercise options are provided with the pulley wheels of the pulley assembly. The exercise bands and the pulley wheels interact with one another to provide additional exercise options.

13 Claims, 6 Drawing Sheets

(56) References Cited

U.S. PATENT DOCUMENTS

| | | | | |
|---|---|---|---|---|
| 2015/0251039 | A1* | 9/2015 | Mikulski | A63B 21/0442 482/126 |
| 2015/0352395 | A1* | 12/2015 | Gregory | A63B 23/1218 482/123 |
| 2017/0157450 | A1* | 6/2017 | Anderson | A63B 1/00 |
| 2020/0101342 | A1* | 4/2020 | Lawton | A63B 21/4033 |
| 2021/0038941 | A1* | 2/2021 | Marti | A63B 23/03533 |
| 2021/0220691 | A1* | 7/2021 | Ivanov | A63B 21/0435 |
| 2022/0016470 | A1* | 1/2022 | Seamans | A63B 21/16 |
| 2022/0047909 | A1* | 2/2022 | Beecroft | A63B 21/156 |

* cited by examiner

COLLAPSIBLE EXERCISE APPARATUS

BACKGROUND OF THE INVENTION

1. Field of the Invention

The present invention relates to an exercise apparatus, more particularly, to a collapsible exercise apparatus which helps users to exercise multiple muscle groups on one same apparatus.

2. Description of the Related Art

Several designs for exercise apparatuses have been designed in the past. None of them, however, include an elastic band exercise bar comprising a modular square tubing having an insertable base which is configured to be buried in the ground or bolted to a floor surface, wherein the bar includes a plurality of attachment points positioned along the length thereof for attaching elastic exercise bands. The bar includes mounting brackets that secure multiple pads for kicking/punching exercises.

Applicant believes that a related reference corresponds to U.S. Pat. No. 10,512,813 for a multi-user station for attaching multiple elastic exercise bands. Applicant believes that another related reference refers to U.S. Pat. No. 5,536,229 for a height adjustable exercise device that consists of a post with a padded bar attached. None of these references, however, teach of a modular exercise device which includes a plurality of attachment points that each allow a different muscle group to be targeted with exercise bands. Additionally, the present invention also includes multiple pads for practicing punches and kicks.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an exercise apparatus that is portable and collapsible.

It is another object of this invention to provide an exercise apparatus that allows targeting of multiple muscle with exercise bands.

It is still another object of the present invention to provide an exercise apparatus that allows the practicing of executing proper punches and kicks.

It is also another object of the present invention to provide an exercise apparatus that helps to improve the health and physical fitness of users.

It is additionally an object of the present invention to provide an exercise apparatus that is modular.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
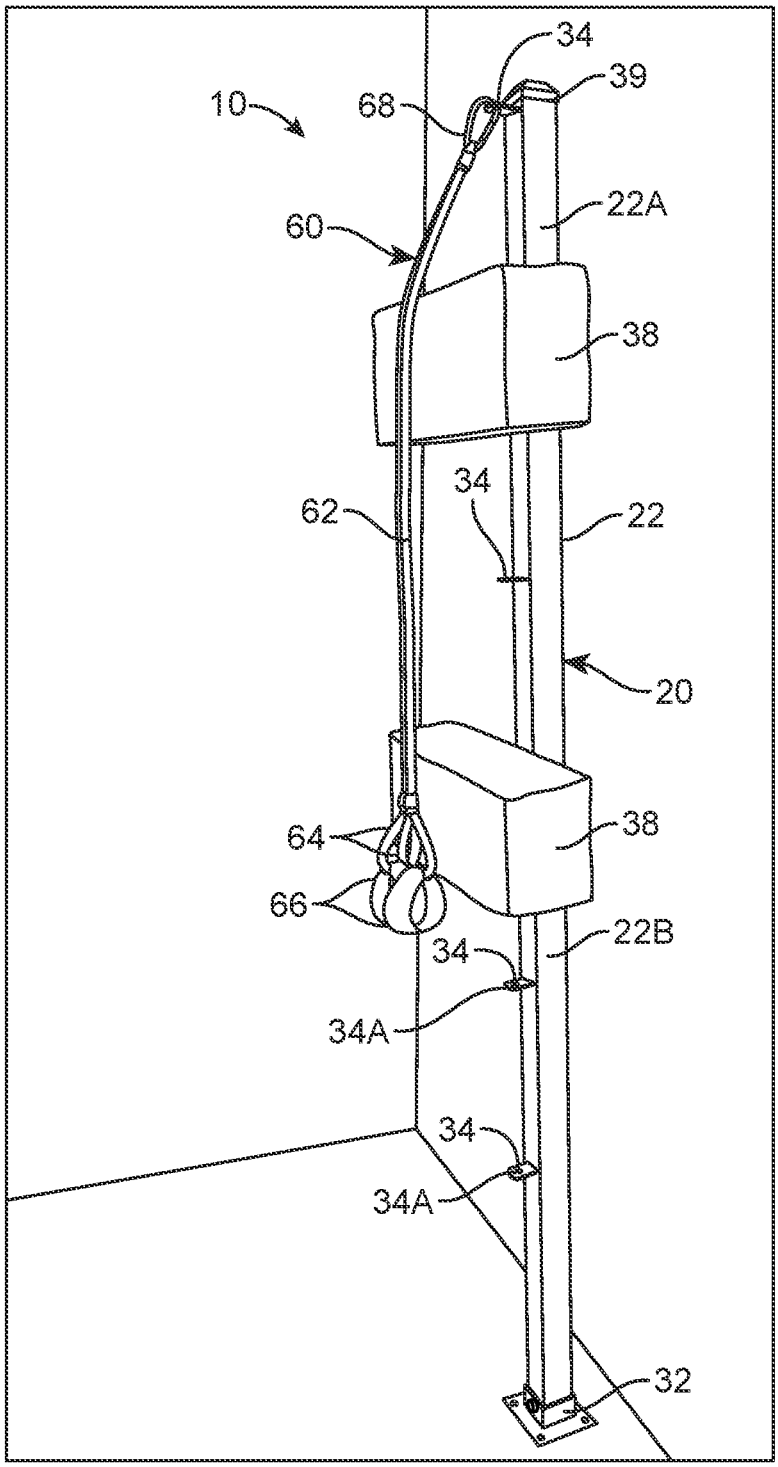
FIG. 1 represents an isometric view of exercise apparatus 10 assembled.

Referring now to the drawings, where the present invention is generally referred to with numeral 10, it can be observed that it basically includes an exercise bar assembly 20, a pulley assembly 40 and an exercise band assembly 60.

Exercise apparatus 10 may help users to become and remain active for improved physical fitness. Thereby ultimately leading to improved health and well-being for users. Importantly, exercise apparatus 10 may be collapsible and portable. Which provides convenience to users by allowing users to easily train and workout anywhere. Advantageously, exercise apparatus 10 is modular allowing users to target multiple muscle groups with one same piece of equipment.

As best illustrated in FIGS. 1-6, exercise apparatus 10 may include exercise bar assembly 20. Exercise bar assembly 20 may include an exercise bar 22. In one embodiment, exercise bar 22 may have a square configuration. In the preferred embodiment, exercise bar 22 may be made of aluminum, plastic, rubber, wool, steel or other suitable materials. Preferably, exercise bar 22 may be hollow. Exercise bar 22 may be defined by a top tubing 22A and a bottom tubing 22B. Each of top tubing 22A and bottom tubing 22B may have a square configuration. It may be suitable for top tubing 22A to be shorter than bottom tubing 22B.

At a bottom end of top tubing 22A may be located a height adjustment member 24. Height adjustment member 24 may preferably have a rounded cylindrical configuration. Height adjustment member 24 may have a length less than top tubing 22A, in one implementation. Height adjustment member 24 may include through holes 24A extending along a height of height adjustment member 24. Through holes 24A may be parallel to each other. At a top end of bottom tubing 22B may be located a receiving opening 25 which extends a predetermined depth into bottom tubing 22B. Bottom tubing 22B may further include a bottom tubing through hole 26 near a top end extending therethrough. It is to be understood that receiving opening 25 may be square shaped, in one embodiment. Height adjustment member 24 may be received within receiving opening 25 to attach top tubing 22A and bottom tubing 22B together. It is to be understood that height adjustment member 24 may be selectively exposed between top tubing 22A and bottom tubing 22B. It may be suitable for top tubing 22A and bottom tubing 22B to be in constant abutting contact when height adjustment member 24 is entirely received within receiving opening 25 and concealed. To adjust the height of exercise bar 22, height adjustment member 24 may be partially retrieved and exposed from bottom tubing 22B. Such that one of through holes 24A aligns with bottom tubing through hole 26. With one of through holes 24A aligned with bottom tubing through hole 26, a pin member 28 may be insert therethrough. Thereby securing top tubing 22A and bottom tubing 22B together at an adjusted height. More specifically, securing height adjustment member 24 to bottom tubing 22B. It may be suitable for pin member 28 to include a pin member head 28A which may be used to facilitate gripping and operating of the pin member 28 in and out of the desired of through holes 24A and bottom tubing through hole 26. Bottom tubing 22B may further include a bottom tubing aperture 27 at a bottom distal end extending therethrough.

It is to be understood that exercise bar 22 may preferably be secured to a ground surface. Exercise bar assembly 20 may further include a base 32. It may be suitable for base 32 to be buried into the ground surface in one embodiment. It may be suitable for base 32 to be bolted to the ground surface in an alternate implementation. Base 32 may include a lip extending outwardly and away from base 32 about an entire perimeter thereof. The lip may include fastener openings to receive fasteners to secure base 32 to the ground surface. It is to be understood that a bottom distal end of bottom tubing 22B may be received within base 32 to support exercise bar 22 in an upright position. Importantly, base 32 may have a width that is slightly greater than that of bottom tubing 22B to allow bottom tubing 22B to be snuggly received therein. It may be suitable, in one embodiment, for base 32 to include a base lip 32A extending about an entire perimeter of base 32. Base lip 32A may be secured to the bottom portion of base 32. Base lip 32 may be substantially flat. Base lip 32A may include fastener openings to help receive fasteners to secure base 32 to a ground surface. Extending through base 32 from a side of base 32 may be a base through hole 32B. It is to be understood that when bottom tubing 22B is received within base 32, bottom tubing aperture 27 and base through hole 32B may align. Subsequently, a base pin 32C may extend therethrough, simultaneously through bottom tubing aperture 27 and base through hole 32B. Thereby allowing for exercise bar 22 to be more securely attached to base 32 and prevent accidental movement, especially when multiple users are exercising on the present invention. Base pin 32C may extend perpendicularly to bottom tubing 22B and base 32.

Figure 2:
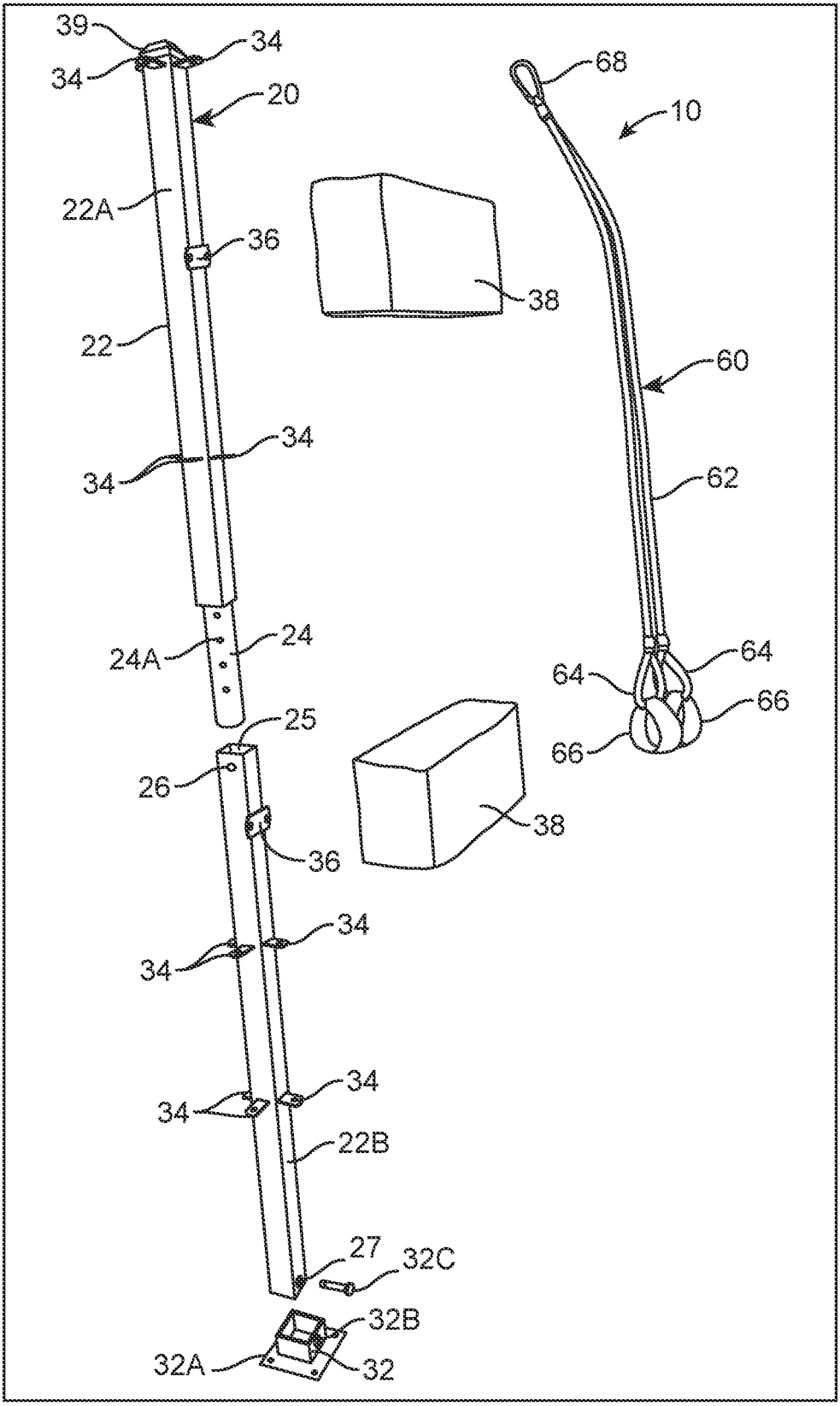
FIG. 2 shows an exploded view of exercise apparatus 10, in accordance with an embodiment of the present invention.
Figure 3:
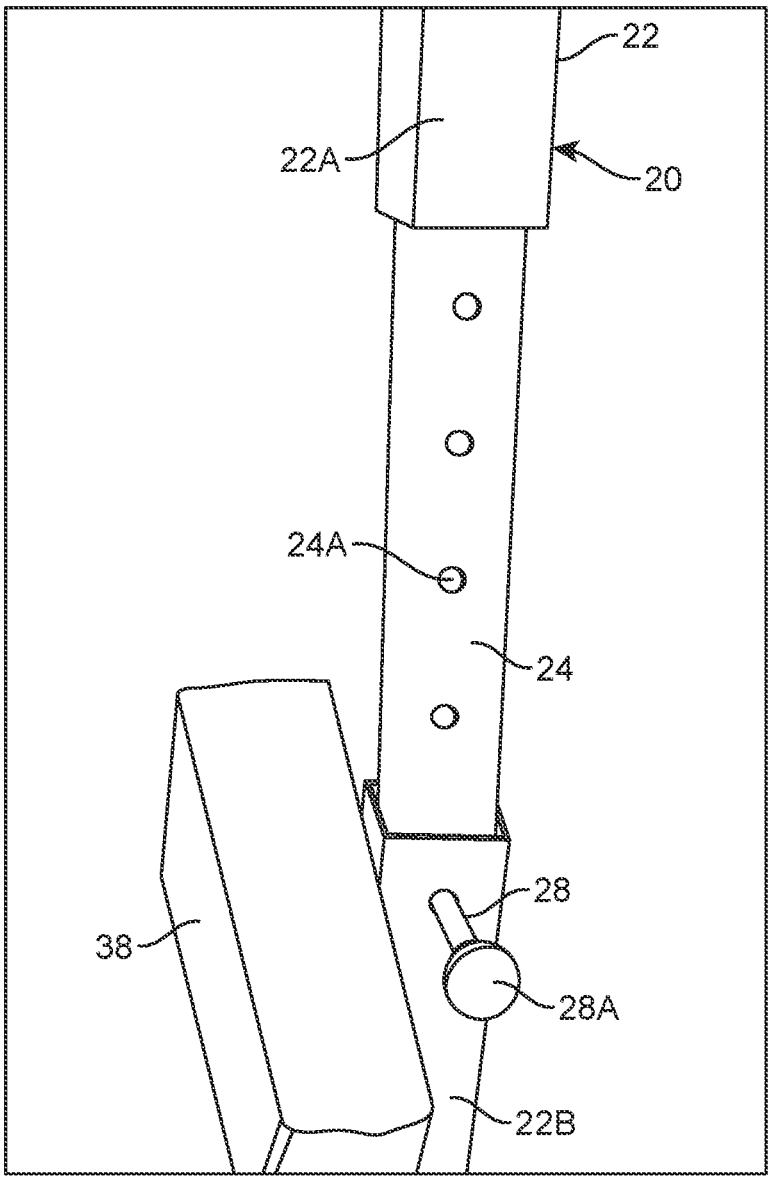
FIG. 3 illustrates a zoomed in view of the height adjustment member 24.

Along a height of exercise bar 22 may be located a plurality of attachment point rods 34. Attachment point rods 34 may be located at predetermined locations along the height of exercise bar 22. More specifically, attachment point rods 34 may be located at predetermined locations along top tubing 22A and bottom tubing 22B. Attachment point rods 34 may be secured perpendicularly to exercise bar 22. Attachment point rods 34 may extend outwardly and away from exercise bar 22. In one embodiment, attachment point rods 34 may be integral with exercise bar 22. In an alternate embodiment, attachment point rods 34 may be welded onto exercise bar 22. It is to be understood that attachment point rods 34 may be parallel to each other along the height of exercise bar 22. In one implementation, it may be suitable for attachment point rods 34 to be on one same side of exercise bar 22, as illustrated in FIG. 1. In another implementation, it may be suitable for attachment point rods 34 to be located about a perimeter of exercise bar 22, as best illustrated in FIG. 2. Thereby allowing for more than one person to make use of exercise bar 22 for exercise. Attachment point rods 34 may have a rounded distal end, preferably. Importantly, each of attachment point rods 34 to include an attachment rod aperture 34A extending therethrough. Attachment rod aperture 34A permits for exercise equipment to be removably attached to attachment point rods 34 such as exercise band assembly 60.

Additionally, located along the height of exercise bar 22 at predetermined locations may be mounting brackets 36, as best illustrated in FIG. 2. Each of top tubing 22A and bottom tubing 22B may include at least one of mounting brackets 36. Preferably, mounting brackets 36 may be arranged horizontally on exercise bar 22. It may be suitable for mounting brackets 36 to have a width greater than exercise bar 22. Mounting brackets 36 may have an oblong shape, in the preferred embodiment. It can be seen that preferably mounting brackets 36 may be located between attachment point rods 34. It is to be understood that mounting brackets 36 may include fastener through holes along the left and right side. Mounting brackets 36 may help to secure pads 38 to exercise bar 22. Fasteners and faster through holes on mounting brackets 36 may be used to secured pads 38 thereto. Pads 38 may be made of a cushion material. Pads 38 may be used to practice kicking or punching without injuring the user. Pads 38 may be made to absorb the force from the punch or kick thrown by the user. Pads 38 help to provide added exercise options to the users. Pads 38 may preferably have a rectangular configuration.

As exercise bar 22 may preferably be made hollow, a top cap 39 may be removably secured to the top distal end of exercise bar 22. Top cap 39 may be tapered and pointed in one embodiment. Top cap 39 may help to prevent access to an interior of exercise bar 22. This helps to protect exercise bar 22 from weather conditions that may rust exercise bar 22 from the inside. Additionally, top cap 39 may help prevent critters from entering exercise bar 22.

Figure 4:
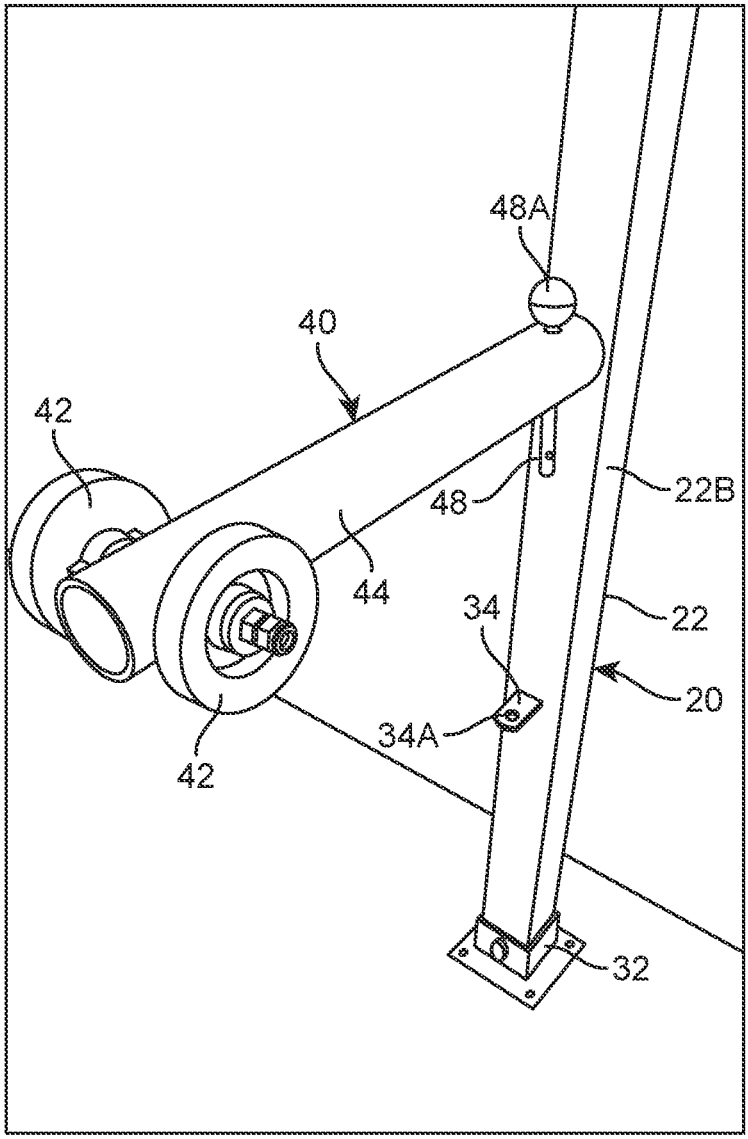
FIG. 4 is a representation of a zoomed in view of the pulley assembly 40 secured to exercise bar 22.
Figure 5:
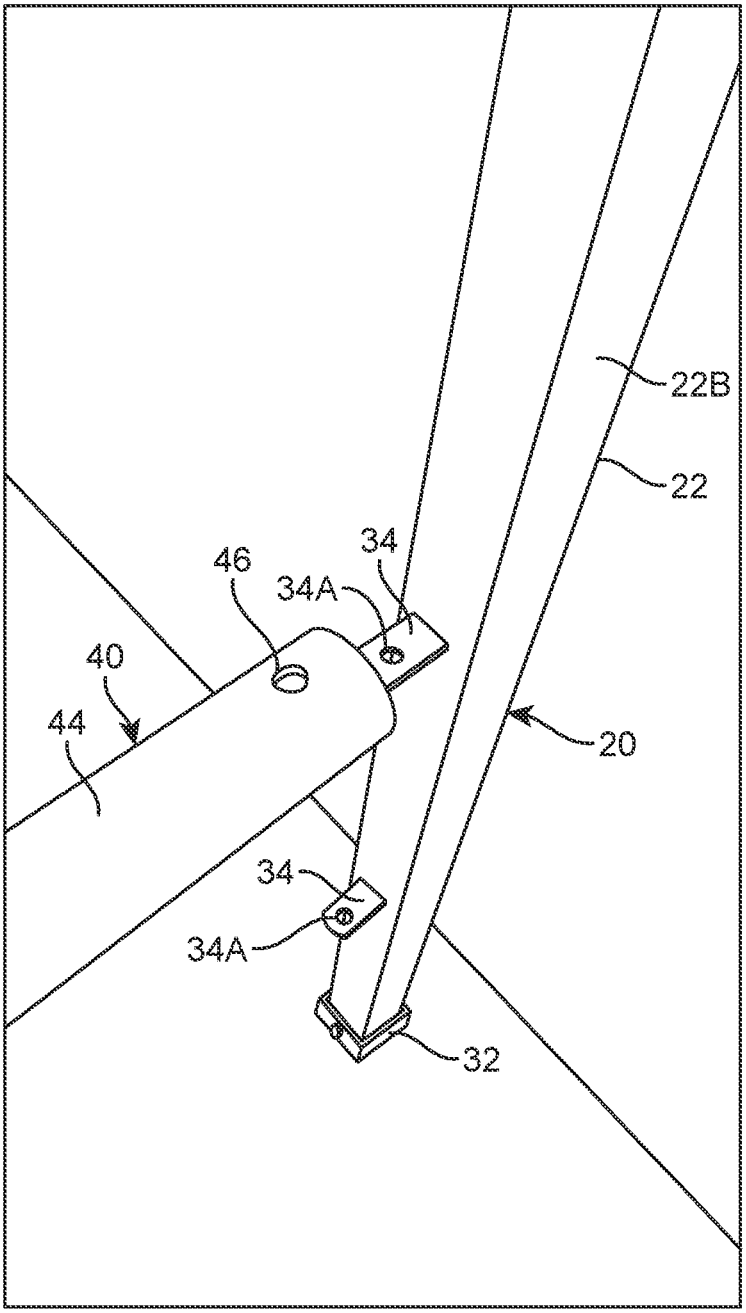
FIG. 5 represents a zoomed in view of pulley assembly 40 being detached from exercise apparatus 10.
Figure 6:
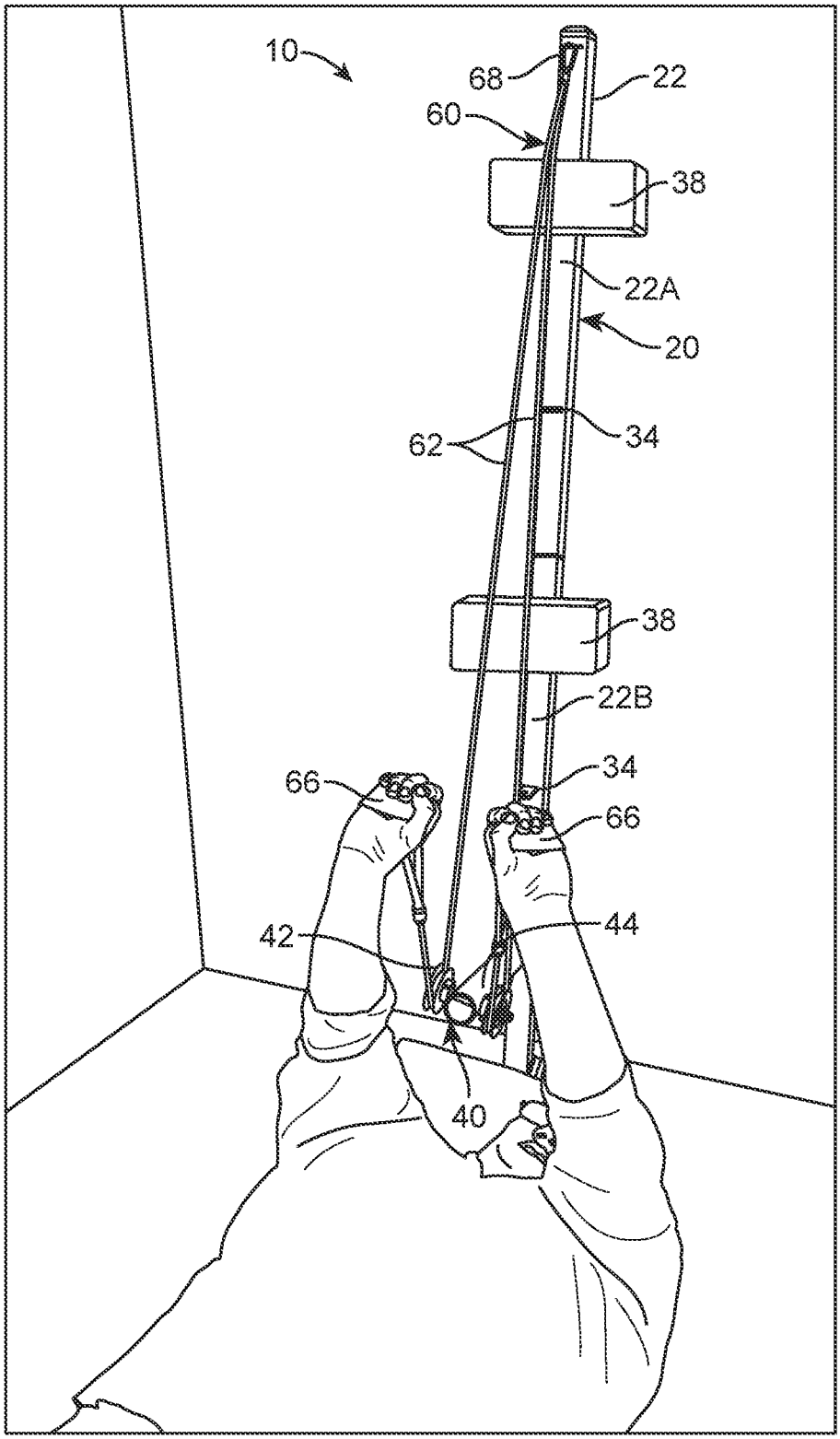
FIG. 6 shows an operational view of exercise apparatus 10 being used for chest exercises.

As best illustrated in FIGS. 4-6, it can be seen that exercise apparatus 10 may include pulley assembly 40. Pulley assembly 40 may help to provide additional exercise options for the users. It may be suitable for pulley assembly 40 to cooperate with exercise band assembly 60 to target multiple muscle groups. It is to be understood that pulley assembly 40 may be removably secured to exercise bar 22. Pulley assembly 40 may include pulley wheels 42 secured to a distal end of a support member 44 at lateral sides thereof. Pulley wheels 42 may be parallel to each other. Pulley wheels 42 may be secured to support member 44 with a fastener extending therethrough. Pulley wheels 42 may rotate when operated. Support member 44 may preferably be hollow. It can be best seen in FIG. 5 that support member 44 may include a pin opening 46 extending through at a rear distal side thereof. To secure pulley assembly 40 to exercise bar 22, support member 44 may be secured to one of attachment point rods 34. Support member 44 may entirely receive one of attachment point rods 34 within. Such that attachment point aperture 34A and pin opening 46 align with each other. With attachment point aperture 34A and pin opening 46 aligned, a pin 48 may be inserted therethrough. Thereby securing pulley assembly 40 to exercise bar 22. Pin 48 may be perpendicular to support member 44. Pin 48 may have a pin head 48A at a top distal end thereof. Pin head 48A may help to facilitate grasping of pin 48. It may be suitable for pin 48 to include a locking ball near a bottom thereof. To help prevent accidental removal of pin 48.

Importantly, exercise apparatus 10 may include exercise band assembly 60 to help provide additional exercise options to the users. Exercise band assembly 60 may assist users to target multiple muscle groups with one same accessory. Exercise band assembly 60 may include exercise bands 62 which may preferably be elastic bands. In the preferred embodiment, there may be two of exercise bands 62. Exercise bands 62 may expand and compress when used during exercise to provide resistance to the user for an efficient workout. Exercise bands 62 may be attached together at a top distal end thereof. At a bottom end of exercise bands 62 may be handle loops 64. Handle loops 64 may preferably have a circular configuration. Handle loops 64 may preferably be made of a same material as exercise bands 62. It may be suitable for handle loops 64 may be integral with exercise bands 62. Attached to handle loops 64 may be handle straps 66. Handle straps 66 may be grasped by users to operate exercise bands 62. Handle straps 66 may be interlinked with handle loops 64. It is to be understood that handle loops 64 may have a smaller width than handle straps 66. Users may pull on exercise bands 62 by pulling on handle straps 66 to exercise the desired muscle group. At a top end of exercise bands 62 may be a clip 68. Clip 68 may be secured to any of attachment point rods 34 depending on the desired muscles to target, to secure exercise bands 62 to exercise bar 22. More specifically, clip 68 may be secured to a desired of attachment rod aperture 34A. In one embodiment clip 68 may be a carabiner. Exercise bands 62 may cooperate with pulley wheels 42 to help provide additional exercise options. Exercise bands 62 may partially wrap about the circumference of pulley wheels 42 to allow for additional exercise options, such as push presses as shown in FIG. 6.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an exercise apparatus, comprising:

a) an exercise bar assembly including an exercise bar secured vertically to a ground surface, said exercise bar including attachment point rods and pads at predetermined locations of said exercise bar along a height thereof; and b) an exercise band assembly including exercise bands, said exercise bands secured to one of said attachment point rods to permit users to target a desired muscle group with said exercise bands, said attachment point rods are perpendicular to said exercise bar, said attachment point rods each including an attachment rod aperture, said system further includes a pulley assembly, said pulley assembly including pulley wheels secured to a support member, said exercise bands are slidably secured to said pulley wheels from underneath said pulley wheels, said support member includes a pin opening at an opposite end from said pulley wheels, one of said attachment point rods is received within said support member such that said attachment rod aperture aligns with said pin opening, a pin extends through said pin opening and said attachment rod aperture to secure said support member to said exercise bar, said pin includes a pin head at a top distal end thereof, said pin head being round and facilitating grasping of said pin.

2. The system of claim 1, wherein said exercise bar is further defined by a top tubing and a bottom tubing secured together.

3. The system of claim 2, wherein said top tubing is shorter than said bottom tubing.

4. The system of claim 2, wherein secured to a bottom of said top tubing is a height adjustment member having through holes extending along a length thereof, said through holes being parallel to each other, said bottom tubing including a receiving opening at a top end thereof, said height adjustment member slidably received within said receiving opening to adjust said height of said exercise bar.

5. The system of claim 4, wherein said bottom tubing includes a bottom tubing through hole along a lateral side at the top end, said bottom tubing through hole aligning with said through holes when said height adjustment member is exposed from said bottom tubing, subsequently a pin member is inserted through the aligned said bottom tubing through hole and said through holes to secure said height adjustment member to said bottom tubing to size said exercise bar at a desired height.

6. The system of claim 5, wherein said pin member includes a pin member head at a top distal end thereof, said pin member head being round and facilitating grasping of said pin member.

7. The system of claim 2, wherein said exercise bar assembly further includes a base, said base secured to the ground surface, said exercise bar secured into said base to secure the exercise bar to the ground surface.

8. The system of claim 7, wherein said bottom tubing includes a bottom tubing aperture, said base including a base through hole, said bottom tubing aperture and said base through hole align when said bottom tubing is secured within said base, subsequently, a base pin extends through said bottom tubing aperture and said base through hole simultaneously to secure said bottom tubing and said base together.

9. The system of claim 1, wherein secured to a top of said exercise bar is a top cap preventing access to an interior of said exercise bar, said top cap being tapered.

10. The system of claim 1, wherein secured to said exercise bar are mounting brackets, said mounting brackets being located in between said attachment point rods, said mounting brackets having a width greater than said exercise bar, said pads secured to said mounting brackets.

11. The system of claim 1, wherein said exercise bands include a clip at a top distal end thereof, said clip secured to said attachment rod aperture of one of said attachment point rods.

12. The system of claim 1, wherein said exercise bands each include handle loops at a bottom distal end thereof, said handle loops having a circular configuration.

13. The system of claim 12, wherein secured to said handle loops are handle straps configured to facilitate usage of said exercise bands, said handle straps allowing said users to grasp said exercise bands for pulling thereof.

* * * * *